US011749483B1

(12) United States Patent
Rosios et al.

(10) Patent No.: US 11,749,483 B1
(45) Date of Patent: Sep. 5, 2023

(54) FUSE WITH COMPARTMENTALIZED BODY AND PARALLEL FUSE ELEMENTS

(71) Applicant: Littelfuse, Inc., Chicago, IL (US)

(72) Inventors: Lily Espenilla Rosios, Chicago, IL (US); Ralph Pechon Labonite, Chicago, IL (US); Arnel Alibuyog Ramos, Chicago, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 17/723,910

(22) Filed: Apr. 19, 2022

(51) Int. Cl.

| | |
|---|---|
| ***H01H 85/175*** | (2006.01) |
| ***H01H 85/165*** | (2006.01) |
| ***H01H 85/20*** | (2006.01) |
| ***H01H 85/42*** | (2006.01) |
| ***H01H 85/12*** | (2006.01) |
| *H01H 85/041* | (2006.01) |

(52) U.S. Cl.
CPC ..... *H01H 85/165* (2013.01); *H01H 85/12* (2013.01); *H01H 85/1755* (2013.01); *H01H 85/2045* (2013.01); *H01H 85/42* (2013.01); *H01H 2085/0414* (2013.01)

(58) Field of Classification Search
CPC .... H01H 85/12; H01H 85/165; H01H 85/175; H01H 85/1755; H01H 85/2045; H01H 85/42; H01H 2085/0412; H01H 2085/0414
See application file for complete search history.

(56) References Cited

U.S. PATENT DOCUMENTS

| | | | | |
|---|---|---|---|---|
| 4,071,837 | A * | 1/1978 | Ranzanigo | H01H 85/165 337/268 |
| 6,194,989 | B1 * | 2/2001 | Douglass | H01H 85/10 337/260 |
| 10,553,387 | B1 * | 2/2020 | Angelini | H01H 69/02 |
| 2009/0027155 | A1 * | 1/2009 | Arikawa | H01H 85/38 337/228 |
| 2015/0295396 | A1 * | 10/2015 | Yang | H05K 1/181 361/93.1 |
| 2015/0340188 | A1 * | 11/2015 | Schmidt | H01H 85/05 337/186 |
| 2020/0388457 | A1 * | 12/2020 | Liu | H01H 85/143 |
| 2021/0118639 | A1 * | 4/2021 | Betti | H01H 85/175 |

* cited by examiner

*Primary Examiner* — Jacob R Crum
(74) *Attorney, Agent, or Firm* — KDW Firm PLLC

(57) ABSTRACT

A fuse including a fuse body having a base with a central portion and first and second sidewalls, the central portion having first and second fastening holes formed therethrough, a mid-body disposed atop the central portion and having first and second troughs formed in a top surface thereof and separated by a partition wall, the mid-body further having first and second through holes formed therethrough, and a cover disposed atop the mid-body and having a central portion and first and second sidewalls, the central portion having first and second fastening bosses extending therefrom and through the first and second through holes of the mid-body and the first and second fastening holes of the base, and a conductive portion including first and second terminal portions connected by parallel first and second fuse members disposed within the first and second troughs of the mid-body and separated by the partition wall.

11 Claims, 6 Drawing Sheets

FUSE WITH COMPARTMENTALIZED BODY AND PARALLEL FUSE ELEMENTS

Field of the Disclosure

The present disclosure relates generally to the field of circuit protection devices, and relates more particularly to a high breaking capacity fuse having a compartmentalized body and parallel fuse elements.

Field of the Disclosure

Fuses are commonly used as circuit protection devices and are typically installed between a source of electrical power and a component in a circuit that is to be protected. One type of fuse, commonly referred to as a "surface mount fuse," includes an electrically insulating fuse body containing a fusible element that extends between electrically conductive, metallic terminals on opposing sides of the fuse body. The terminals typically extend to the underside of the fuse body for providing electrical connections to conductive elements on a printed circuit board (PCB) on which the fuse is mounted. Upon the occurrence of a specified fault condition, such as an overcurrent condition, the fusible element melts or otherwise separates to interrupt the flow of electrical current between an electrical power source and a protected component.

When the fusible element of a fuse separates as a result of an overcurrent condition, it is sometimes possible for an electrical arc to propagate between portions of the fusible element. If not extinguished, the electrical arc may allow significant follow-on currents to flow to from a source of electrical power to a protected component in a circuit, resulting in damage to the protected component despite the physical opening of the fusible element. Moreover, an electrical arc may rapidly heat surrounding air and ambient particulate and may cause a small explosion within a fuse. In some cases, the explosion may burn and/or rupture the fuse body, potentially causing damage to surrounding components. The likelihood of rupture is generally proportional to the severity of the overcurrent condition. The maximum current that a fuse can arrest without rupturing is referred to as the fuse's "breaking capacity." It is generally desirable to maximize the breaking capacity of a fuse without significantly increasing the size or form factor of a fuse. This is especially true in modern electric vehicle applications in which space is limited and current/voltage requirements are very high.

It is with respect to these and other considerations that the present improvements may be useful.

Summary

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

A high breaking capacity surface mount fuse in accordance with an exemplary embodiment of the present disclosure may include an electrically insulating fuse body having a base with a planar central portion and first and second sidewalls disposed on opposing sides of the central portion, the first and second sidewalls having notches formed therein, the central portion having first and second fastening holes formed therethrough adjacent opposing longitudinal ends thereof, a mid-body disposed atop the central portion of the base between the first and second sidewalls of the base and having first and second troughs formed in a top surface thereof, wherein the troughs are separated by a partition wall and are aligned with the notches in the first and second sidewalls of the base, the mid-body further having first and second through holes formed therethrough adjacent opposing longitudinal ends thereof, and a cover disposed atop the mid-body and having a planar central portion and first and second sidewalls disposed on opposing sides of the central portion, the central portion further having first and second fastening bosses extending therefrom adjacent opposing longitudinal ends thereof, wherein the first and second fastening bosses extend through the first and second through holes of the mid-body and the first and second fastening holes of the base. The fuse may further include a conductive portion having opposing first and second terminal portions connected by parallel, spaced apart first and second fuse members, wherein the first and second fuse members are disposed within the first and second troughs of the mid-body and are separated by the partition wall, and wherein the first and second terminal portions cover the sides of the fuse body.

A high breaking capacity surface mount fuse in accordance with another exemplary embodiment of the present disclosure may include an electrically insulating fuse body having a base with first and second troughs formed in a top surface thereof, wherein the troughs are separated by a partition wall, the base further having first and second fastening holes formed therethrough adjacent opposing longitudinal ends thereof, and a cover having first and second troughs formed in a bottom surface thereof and first and second fastening bosses extending therefrom adjacent opposing longitudinal ends thereof, wherein the first and second fastening bosses extend through the first and second fastening holes of the base. The fuse may further include a conductive portion having opposing first and second terminal portions connected by parallel, spaced apart first and second fusible elements, wherein the first and second fusible elements are disposed within the first and second troughs of the base and are separated by the partition wall, and wherein the first and second terminal portions cover sides of the base.

DETAILED DESCRIPTION

Figure 1A:
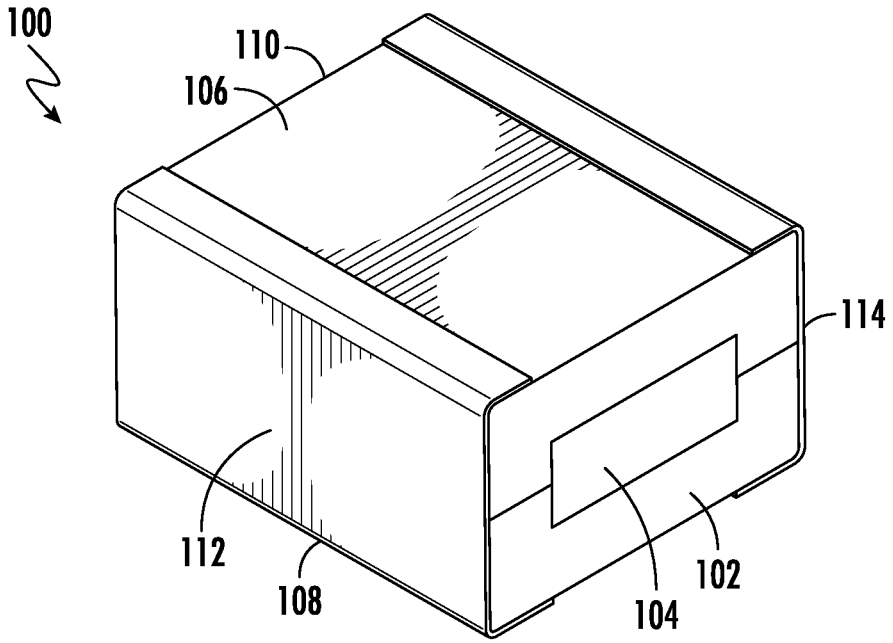
FIG. 1*a* is a top perspective view illustrating a surface mount fuse in accordance with an exemplary embodiment of the present disclosure.

Embodiments of a surface mount fuse in accordance with the present disclosure will now be described more fully with reference to the accompanying drawings, in which preferred embodiments of the present disclosure are presented. The surface mount fuse of the present disclosure may, however, be embodied in many different forms and should not be construed as being limited to the embodiments set forth herein. Rather, these embodiments are provided so that this disclosure will be thorough and complete, and will convey certain exemplary aspects of the surface mount fuse to those skilled in the art. In the drawings, like numbers refer to like elements throughout unless otherwise noted.

Figure 1B:
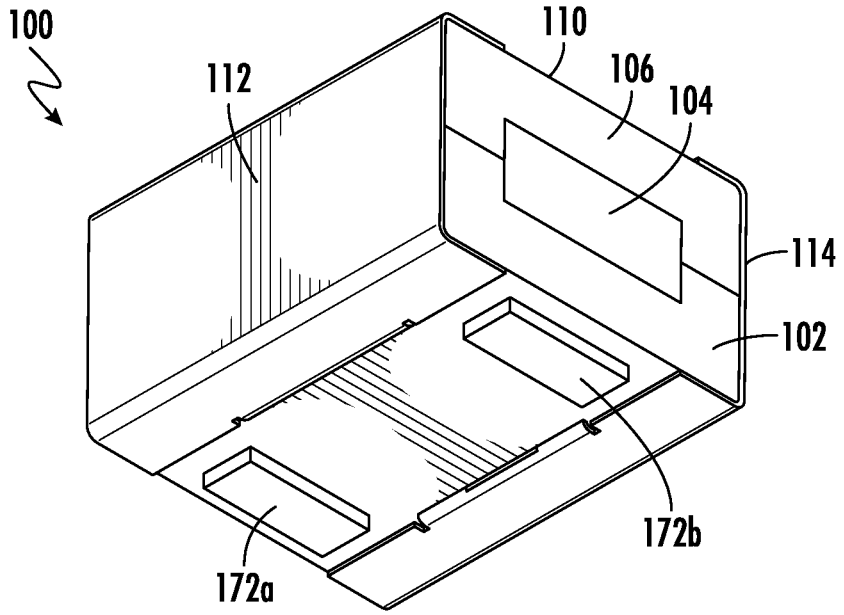
FIG. 1*b* is a bottom perspective view illustrating the surface mount fuse shown in FIG. 1*a;*

Referring to FIGS. 1*a* and 1*b*, top and bottom perspective views of a high breaking capacity surface mount fuse 100 (hereinafter "the fuse 100") in accordance with an exemplary embodiment of the present disclosure are shown, respectively. For the sake of convenience and clarity, terms such as "top," "bottom," "longitudinal," "lateral," "vertical," and "horizontal" may be used herein to describe the relative positions and orientations of various components of the fuse 100, all with respect to the geometry and orientation of the fuse 100 as it appears in FIGS. 1*a* and 1*b*. Said terminology will include the words specifically mentioned, derivatives thereof, and words of similar import. Similar terminology will be used in a similar manner to describe subsequent embodiments disclosed herein.

The fuse 100 may include a base 102, a mid-body 104, a cover 106, and a conductive portion 108. The base 102, mid-body 104, and cover 106, hereinafter referred to collectively as "the fuse body 110," may be disposed in a stacked arrangement in the aforementioned order as further described below. The conductive portion 108 may include first and second terminal portions 112, 114 disposed on opposing sides of the fuse body 110 and extending around top and bottom surfaces of the fuse body 110 as further described below. The fuse body 110 may be formed of any suitable electrically insulating material, including, but not limited to, plastic, ceramic, composite, etc., and the conductive portion 108 may be formed of any suitable electrically conductive material, including, but not limited to, tin, copper, various alloys, etc.

Figure 2:
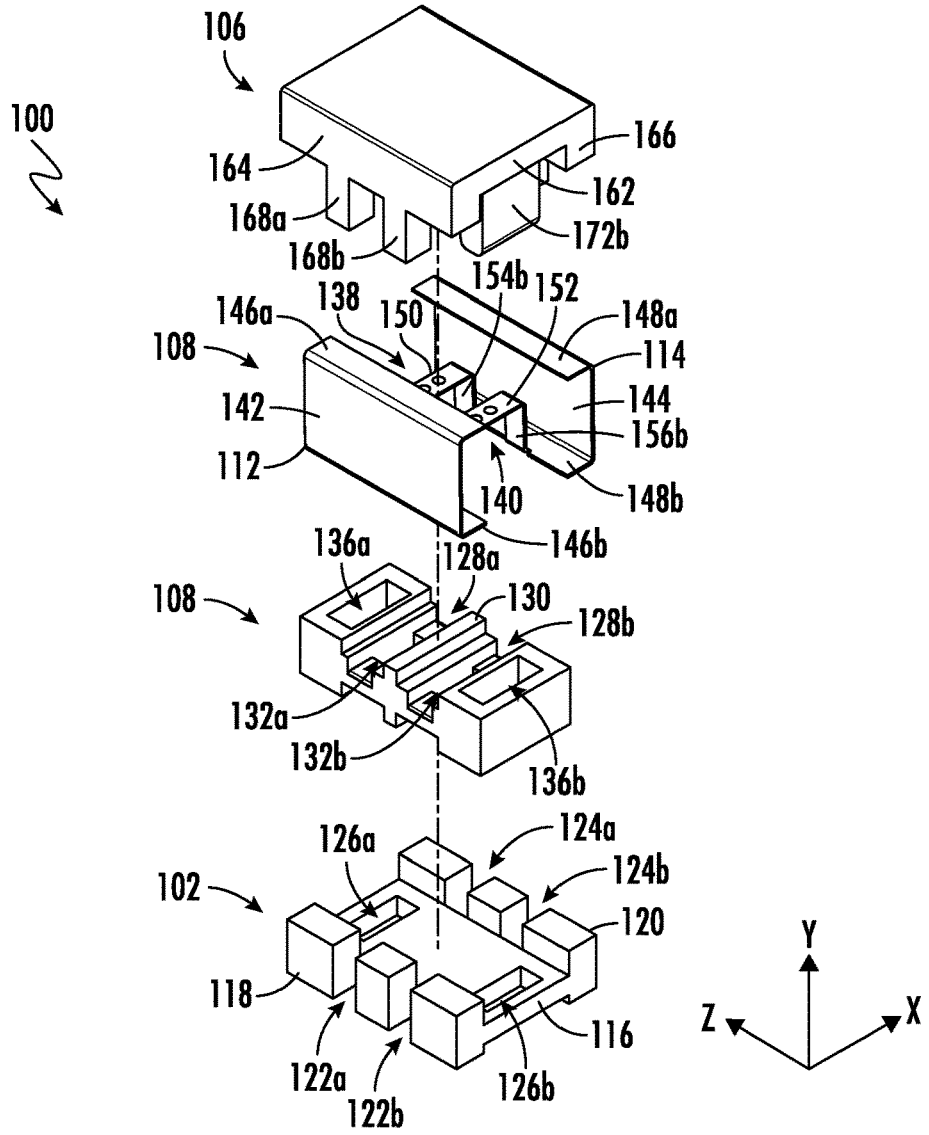
FIG. 2 is an exploded view illustrating the surface mount fuse shown in FIG. 1*a;*

Referring to FIG. 2, an exploded view of the fuse 100 is shown. The base 102 of the fuse 100 may include a substantially planer central portion 116 and segmented first and second sidewalls 118, 120 extending from lateral sides of the central portion 116. Each of the first and second sidewalls 118, 120 may have respective, spaced-apart first and second notches 122*a*, 122*b* and 124*a*, 124*b* formed therein. The first notch 122*a* of the first sidewall 118 may be laterally aligned with the first notch 124*a* of the second sidewall 120 (i.e., aligned in the direction of the x-axis of the illustrated Cartesian coordinate system), and the second notch 122*b* of the first sidewall 118 may be horizontally aligned with the second notch 124*b* of the second sidewall 120. The central portion 116 of the base 102 may have vertically extending first and second fastening holes 126*a*, 126*b* formed therethrough adjacent opposing longitudinal ends of the central portion 116.

The mid-body 104 of the fuse 100 may be a generally block-shaped member having a width (as measured in the direction of the x-axis of the illustrated Cartesian coordinate system) adapted to fit between the first and second sidewalls 118, 120 of the base 102 in a close clearance relationship therewith. The mid-body 104 may have laterally extending first and second troughs 128*a*, 128*b* formed in a top surface thereof. The first and second troughs 128*a*, 128*b* may be spaced apart in the longitudinal direction (i.e., in the direction of the z-axis of the illustrated Cartesian coordinate system) and may be separated by a partition wall 130. The first and second troughs 128*a*, 128*b* may have respective first and second cavities 132*a*, 132*b* formed in respective first and second floors 134*a*, 134*b* thereof. The mid-body 104 is shown as having troughs formed in an underside thereof, but these are not critical and may be omitted without departing from the scope of the present disclosure. The mid-body 104 may have vertically extending first and second through holes 136*a*, 136*b* formed therethrough adjacent opposing longitudinal ends thereof. The size of the first and second through holes 136*a*, 136*b* and the longitudinal distance between the first and second through holes 136*a*, 136*b* may be equal to those of the first and second fastening holes 126*a*, 126*b* of the base 102 such that the first and second through holes 136*a*, 136*b* of the mid-body 104 may be aligned with the first and second fastening holes 126*a*, 126*b* of the base 102 when the fuse 100 is assembled as further described below.

The conductive portion 108 of the fuse 100 may include laterally opposing first and second terminal portions 112, 114 connected by laterally extending, parallel first and second fuse members 138, 140. The first and second terminal portions 112, 114 may include respective vertically oriented first and second sidewalls 142, 144. Each of the first and second sidewalls 142, 144 may have top and bottom flanges 146*a*, 148*a* and 146*b*, 148*b* extending horizontally inwardly (i.e., toward the first and second fuse members 138, 140) from top and bottom edges thereof. The first and second fuse members 138, 140 may include respective horizontally oriented first and second fusible elements 150, 152 that are suspended above the bottom flanges 146*a*, 148*b* and that are connected to the bottom flanges 146*a*, 148*b* by respective, vertically oriented legs 154*a*, 154*b* and 156*a*, 156*b* (the legs 154*a*, 156*a* are not within view in FIG. 2 but are identical to the legs 154*b*, 156*b*). The first and second fusible elements 150, 152 may be configured to melt, disintegrate, or otherwise open if current flowing through the conductive portion 108 exceeds a predetermined threshold, or "current rating," of the fuse 100. In various examples, the first and second fusible elements 150, 152 may include perforations (as shown in FIG. 2), slots, thinned or narrowed segments, and/or various other features for making the fusible elements 150, 152 susceptible to melting or opening when the fuse rating is exceeded. The longitudinal distance between the first and second fuse members 138, 140 may be substantially equal to the longitudinal distance between the first and second cavities 132*a*, 132*b* in the first and second troughs 128*a*, 128*b* of the mid-body 104 (described above).

Notably, the entirety of the conductive portion 108, including the first and second terminal portions 112, 114 and the first and second fuse members 138, 140, may be formed from a single, unitary piece of conductive material. For example, the conductive portion 108 may be stamped or cut from a sheet of copper and bent into the above-described shape/configuration. Thus, unlike traditional fuses, no solder is required to connect the fuse members to the terminal portions. The fuse 100 is therefore easier to assemble and more reliable than traditional fuses. While the conductive portion 108 is described and depicted herein as having two parallel fuse members, alternative embodiments of the present disclosure are contemplated in which the conductive portion 108 is provided with a greater number of parallel fuse members (and a corresponding number of troughs and cavities formed in the mid-body 104). The present disclosure is not limited in this regard.

Figure 3:
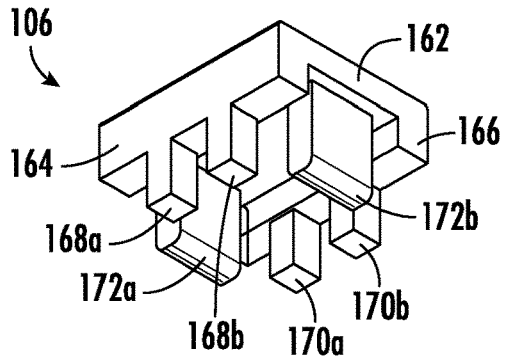
FIG. 3 is a bottom perspective view illustrating a cover of the surface mount fuse shown in FIG. 1*a;*

Referring now to FIGS. 2 and 3, the cover 106 of the fuse 100 may include a substantially planer central portion 162 and first and second sidewalls 164, 166 extending from lateral sides of the central portion 162. Each of the first and second sidewalls 164, 166 may have respective, spaced-apart first and second castellations 168*a*, 168*b* and 170*a*, 170*b* extending therefrom. The first castellation 168*a* of the first sidewall 164 may be laterally aligned with the first castellation 170*a* of the second sidewall 166, and the second castellation 168*b* of the first sidewall 164 may be horizontally aligned with the second castellation 170*b* of the second sidewall 166. The longitudinal distance between the first castellations 168*a*, 170*a* and the second castellations 168*b*, 170*b* may be substantially equal to the longitudinal distance between the first notches 122*a*, 124*a* and second notches 122*b*, 124*b* in the first and second sidewalls 118, 120 of the base 102, and the first and second castellations 168*a*, 168*b* and 170*a*, 170*b* may be sized to be matingly received within the first and second notches 122*a*, 122*b* and 124*a*, 124*b*, respectively, in a close clearance relationship therewith as further described below. The central portion 162 of the cover 106 may additionally have first and second fastening bosses 172*a*, 172*b* extending vertically therefrom adjacent opposing longitudinal ends of the central portion 162. The longitudinal distance between the first and second fastening bosses 172*a*, 172*b* may be substantially equal to the longitudinal distance between the first and second fastening holes 126*a*, 126*b* in the base 102, and the first and second fastening bosses 172*a*, 172*b* may be sized to be matingly received within the and second fastening holes 126*a*, 126*b* as further described below.

Figure 4:
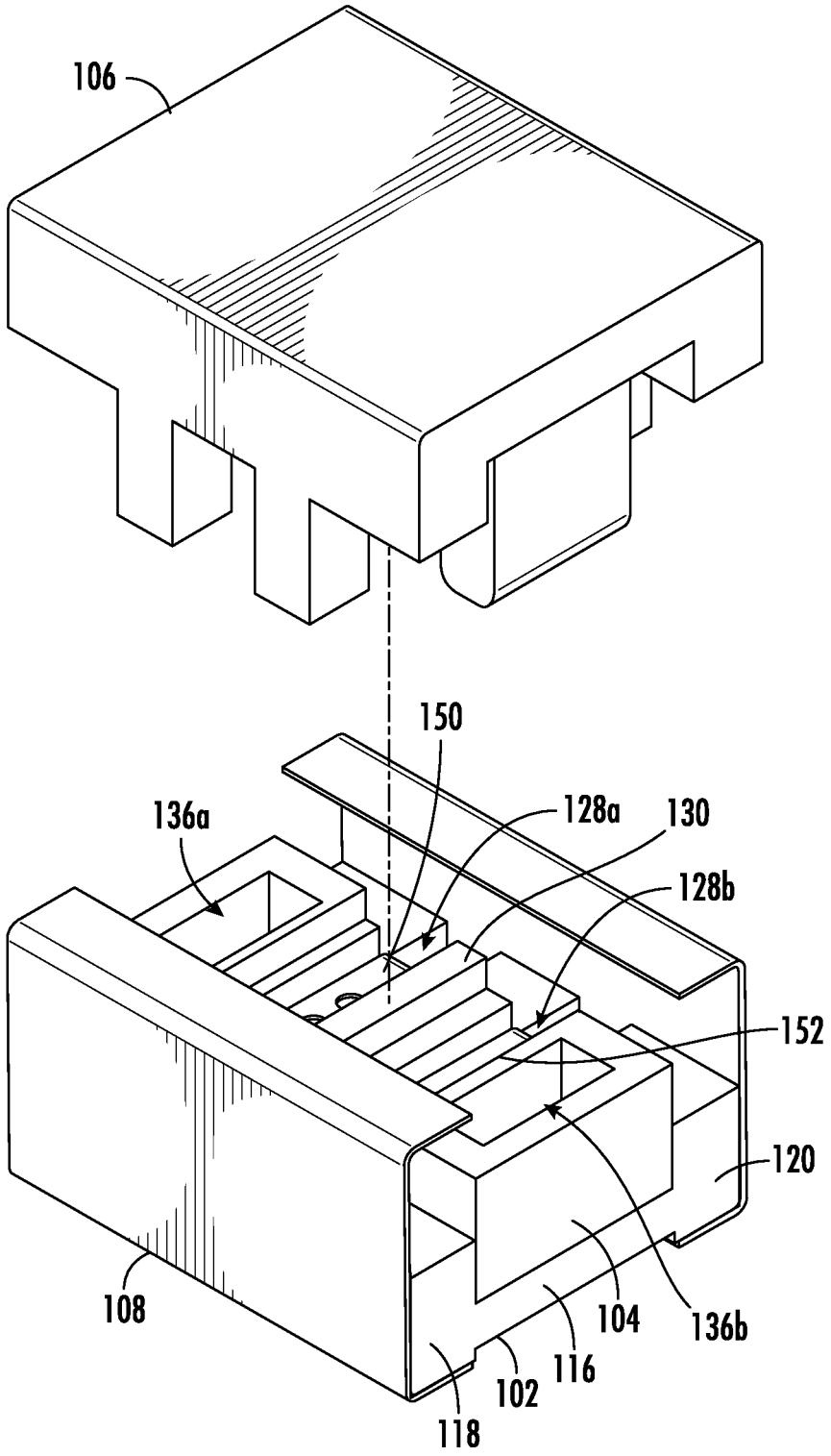
FIG. 4 is a partially exploded view illustrating the surface mount fuse shown in FIG. 1*a;*

Referring to FIG. 4, the fuse 100 is shown with the base 102, the mid-body 104, and the conductive portion 108 in an assembled state (and with the cover 106 exploded away). The mid-body 104 may be disposed on the central portion 116 of the base 102, between the first and second sidewalls 118, 120, with the first and second through holes 136*a*, 136*b* of the mid-body 104 aligned with the first and second fastening holes 126*a*, 126*b* of the base 102 (see also FIG. 2). The conductive portion 108 may be disposed atop the mid-body 104, with the first and second fusible elements 150, 152 disposed within the first and second troughs 128*a*, 128*b* and with the legs 154*a*, 154*b* and 156*a*, 156*b* (not within view) disposed within the first and second notches 122*a*, 122*b* and 124*a*, 124*b* in the first and second sidewalls 118, 120 of the base 102. Thus, the first and second fusible elements 150, 152 may be compartmentalized within the mid-body 104, with the partition wall 130 providing an electrically insulating barrier therebetween. Electrical arcing between the first and second fusible elements 150, 152 is thereby prevented or mitigated. This arrangement provides the fuse 100 with a high breaking capacity (e.g., greater than 1500 A at 48 V).

When the fuse 100 is fully assembled as shown in FIGS. 1*a* and 1*b*, the cover 106 may be disposed atop the mid-body 104 with the first and second castellations 168*a*, 168*b* and 170*a*, 170*b* of the first and second sidewalls 164, 166 (see also FIG. 3) disposed within the first and second notches 122*a*, 122*b* and 124*a*, 124*b* of the base 102 (see also FIG. 2), and with the first and second fastening bosses 172*a*, 172*b* extending through the first and second through holes 136*a*, 136*b* of the mid-body 104 and into the first and second fastening holes 126*a*, 126*b* of the base 102 (see also FIGS. 2 and 3). In various embodiments, the first and second fastening bosses 172*a*, 172*b* may be heat staked within the first and second fastening holes 126*a*, 126*b* to securely fasten the cover 106 to the base 102. The present disclosure is not limited in this regard. In various alternative embodiments, the first and second fastening bosses 172*a*, 172*b* may secured within the first and second fastening holes 126*a*, 126*b* via snap fit or the like. Thus, the entire fuse 100 may be assembled without the use of solder or adhesives. Additionally, the first and second terminal portions 112, 114 of the conductive portion 108, which have a large mass and cover the sides of the fuse body 110 and extend around the top and bottom of the fuse body 110, may also act as heat sinks for the first and second fuse members 138, 140 to facilitate lower temperature rise values relative to traditional surface mount fuses.

In various embodiments, the first and second troughs 128*a*, 128*b* and first and second cavities 132*a*, 132*b* of the mid-body 104 of the fuse 100 may be partially or entirely filled with an arc-quenching material or "fuse filler" (not shown) that may surround the first and second fusible elements 150, 152. The arc-quenching material may be provided for mitigating electrical arcing across separated portions of the first and second fusible elements 150, 152 after the first and second fusible elements 150, 152 are melted (e.g., upon the occurrence of an overcurrent condition in the fuse 100) and may thereby further enhance the breaking capacity of the fuse 100. Arc-quenching materials may include, but are not limited to, sand, silica, etc.

Figure 5A:
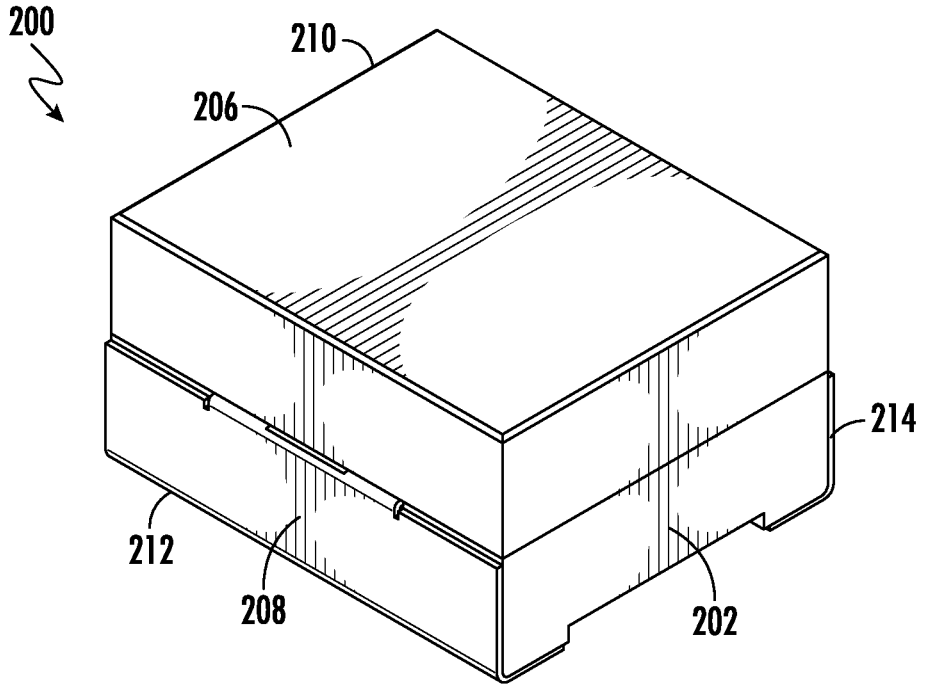
FIG. 5*a* is a top perspective view illustrating a surface mount fuse in accordance with another exemplary embodiment of the present disclosure.
Figure 5B:
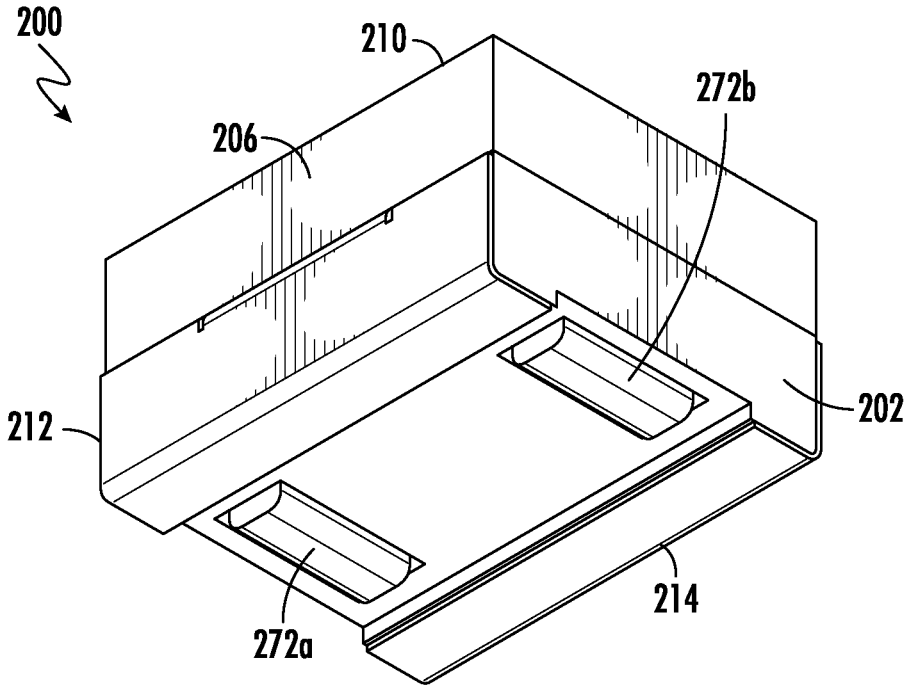
FIG. 5*b* is a bottom perspective view illustrating the surface mount fuse shown in FIG. 5*a;*

Referring to FIGS. 5*a* and 5*b*, top and bottom perspective views of another surface mount fuse 200 (hereinafter "the fuse 200") in accordance with an exemplary embodiment of the present disclosure are shown, respectively. The fuse 200 may include a base 202, a cover 206, and a conductive portion 208. The base 202 and cover 206, hereinafter referred to collectively as "the fuse body 210," may be disposed in a stacked arrangement in the aforementioned order as further described below. The conductive portion 208 may include first and second terminal portions 212, 214 disposed on opposing sides of the base 202 and extending around the bottom surface of the base 202 as further described below. The fuse body 210 may be formed of any suitable electrically insulating material, including, but not limited to, plastic, ceramic, composite, etc., and the conductive portion 208 may be formed of any suitable electrically conductive material, including, but not limited to, tin, copper, various alloys, etc.

Figure 7:
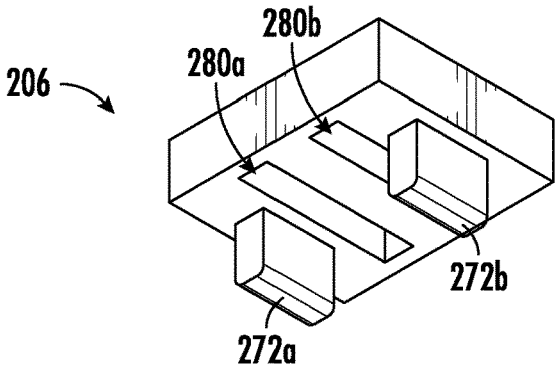
FIG. 7 is a bottom perspective view illustrating a cover of the surface mount fuse shown in FIG. 5*a;*

Referring to FIG. 7, an exploded view of the fuse 200 is shown. The base 202 of the fuse 200 may be a generally block-shaped member having laterally extending (i.e., extending in the direction of the x-axis of the illustrated Cartesian coordinate system) first and second troughs 228*a*, 228*b* formed in a top surface thereof. The first and second troughs 228*a*, 228*b* may be spaced apart in the longitudinal direction (i.e., in the direction of the z-axis of the illustrated Cartesian coordinate system) and may be separated by a partition wall 230. The base 202 may further include vertically extending first and second fastening holes 226*a*, 226*b* formed therethrough adjacent opposing longitudinal ends of the base 202.

Figure 6:
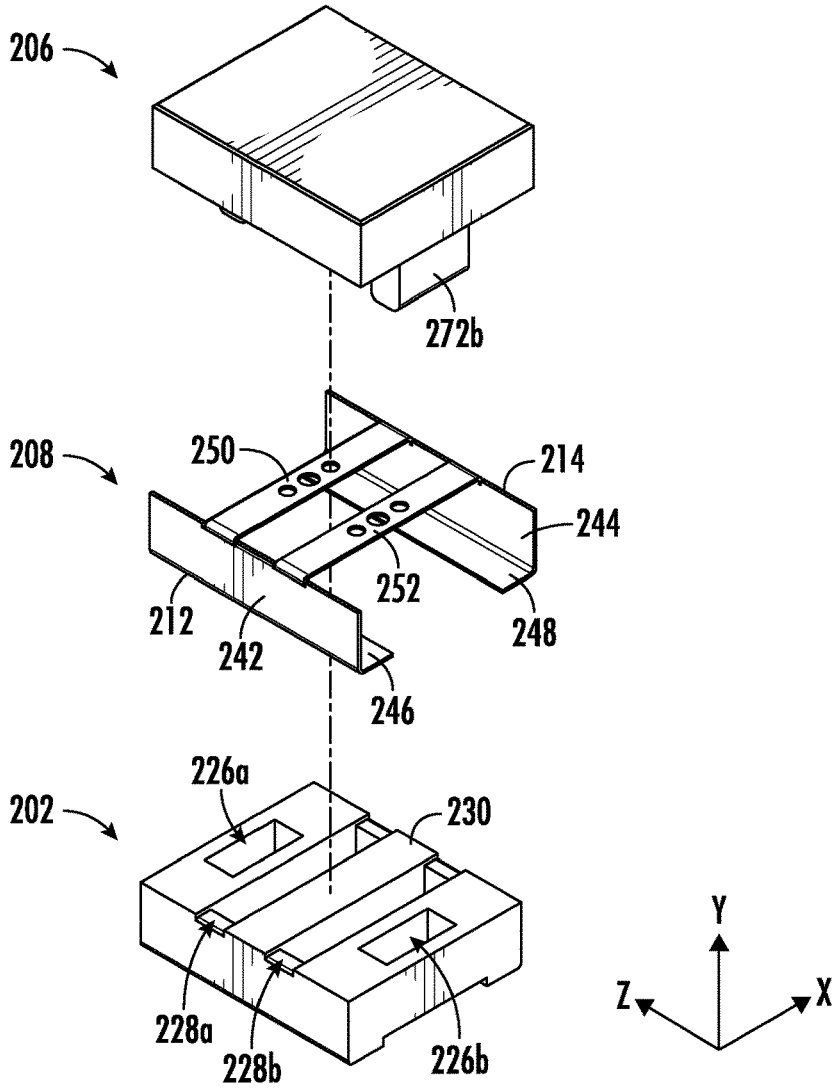
FIG. 6 is an exploded view illustrating the surface mount fuse shown in FIG. 5*a;*

The conductive portion 208 of the fuse 200 may include laterally opposing first and second terminal portions 212, 214 connected by laterally extending, parallel first and second fusible elements 250, 252. The first and second terminal portions 212, 214 may include respective vertically oriented first and second sidewalls 242, 244. The first and second sidewalls 242, 244 may have respective bottom flanges 246, 248 extending horizontally inwardly (i.e., toward the first and second fusible elements 250, 252) from bottom edges thereof. The first and second fusible elements 250, 252 may be suspended above the bottom flanges 246, 248 and connected to the top edges of the first and second terminal portions 212, 214. The first and second fusible elements 250, 252 may be configured to melt, disintegrate, or otherwise open if current flowing through the conductive portion 208 exceeds a predetermined threshold, or "current rating," of the fuse 200. In various examples, the first and second fusible elements 250, 252 may include perforations (as shown in FIG. 6), slots, thinned or narrowed segments, and/or various other features for making the first and second fusible elements 250, 252 susceptible to melting or opening when the current rating is exceeded. The longitudinal distance between the first and second fusible elements 250, 252 may be substantially equal to the longitudinal distance between the first and second troughs 228*a*, 228*b* of the base 202 (described above).

Notably, the entirety of the conductive portion 208, including the first and second terminal portions 212, 214 and the first and second fusible elements 250, 252, may be formed from a single, unitary piece of conductive material. For example, the conductive portion 208 may be stamped or cut from a sheet of copper and bent into the above-described shape/configuration. Thus, unlike traditional fuses, no solder is required to connect the fuse elements to the terminal portions. The fuse 200 is therefore easier to assemble and more reliable than traditional fuses. While the conductive portion 208 is described and depicted herein as having two parallel fuse members, alternative embodiments of the present disclosure are contemplated in which the conductive portion 208 is provided with a greater number of parallel fuse members (and a corresponding number of troughs formed in the base 202). The present disclosure is not limited in this regard.

Referring now to FIGS. 6 and 7, the cover 206 of the fuse 200 may be a generally block-shaped member having a width (as measured in the direction of the x-axis of the illustrated Cartesian coordinate system) substantially equal to a width of the base 202. The cover 206 may having laterally extending first and second troughs 280*a*, 280*b* formed in a bottom surface thereof. The longitudinal distance between the first and second troughs 280*a*, 280*b* may be substantially equal to the longitudinal distance between the first and second troughs 228*a*, 228*b* of the base 202. The cover 206 may additionally include first and second fastening bosses 272*a*, 272*b* extending vertically therefrom adjacent opposing longitudinal ends of the cover 206. The longitudinal distance between the first and second fastening bosses 272*a*, 272*b* may be substantially equal to the longitudinal distance between the first and second fastening holes 226*a*, 226*b* in the base 202, and the first and second fastening bosses 272*a*, 272*b* may be sized to be matingly received within the and second fastening holes 226*a*, 226*b* as further described below.

Figure 8:
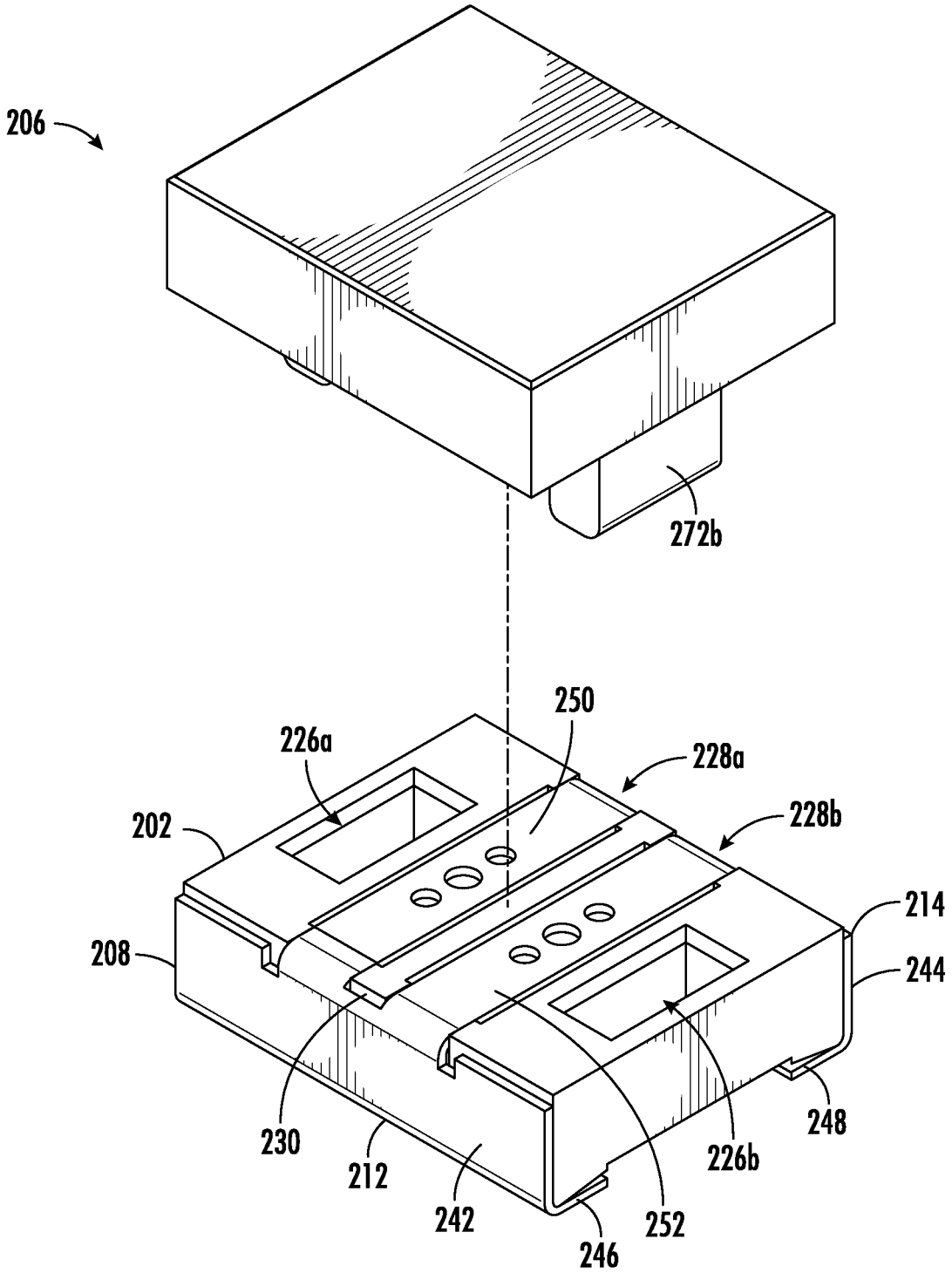
FIG. 8 is a partially exploded view illustrating the surface mount fuse shown in FIG. 5*a*.

Referring to FIG. 8, the fuse 200 is shown with the base 202 and the conductive portion 208 in an assembled state (and with the cover 206 exploded away). The conductive portion 208 may be disposed atop the base 202, with the first and second fusible elements 250, 252 disposed within the first and second troughs 228*a*, 228*b*. Thus, the first and second fusible elements 250, 252 may be compartmentalized within the base 102, with the partition wall 230 providing an electrically insulating barrier therebetween. Electrical arcing between the first and second fusible elements 250, 252 is thereby prevented or mitigated. This arrangement provides the fuse 200 with a high breaking capacity (e.g., greater than 1500 A at 48 V).

When the fuse 200 is fully assembled (as shown in FIGS. 5*a* and 5*b*), the cover 206 may be disposed atop the base 202 with the first and second fastening bosses 272*a*, 272*b* extending into the first and second fastening holes 226*a*, 226*b* of the base 202 and with the first and second troughs 280*a*, 280*b* of the cover 206 disposed over the first and second fusible elements 150, 152. In various embodiments, the first and second fastening bosses 272*a*, 272*b* may be heat staked within the first and second fastening holes 226*a*, 226*b* to securely fasten the cover 206 to the base 204. The present disclosure is not limited in this regard. In various alternative embodiments, the first and second fastening bosses 272*a*, 272*b* may secured within the first and second fastening holes 226*a*, 226*b* via snap fit or the like. Thus, the entire fuse 200 may be assembled without the use of solder or adhesives. Additionally, the first and second terminal portions 212, 214 of the conductive portion 208, which have a large mass and cover the sides of the base 202 and extend around the bottom of the base 202, may also act as heat sinks for the first and second fusible elements 250, 252 to facilitate lower temperature rise values relative to traditional surface mount fuses.

In various embodiments, the first and second troughs 128*a*, 128*b* of the base 202 and the first and second troughs 280*a*, 280*b* of the cover 206 may be partially or entirely filled with an arc-quenching material or "fuse filler" (not shown) that may surround the first and second fusible elements 250, 252. The arc-quenching material may be provided for mitigating electrical arcing across separated portions of the first and second fusible elements 250, 252 after the first and second fusible elements 250, 252 are melted (e.g., upon the occurrence of an overcurrent condition in the fuse 200) and may thereby further enhance the breaking capacity of the fuse 200. Arc-quenching materials may include, but are not limited to, sand, silica, etc.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A fuse comprising:

an electrically insulating fuse body comprising:

a base having a planar central portion and first and second sidewalls disposed on opposing sides of the central portion, the first and second sidewalls having notches formed therein, the central portion having first and second fastening holes formed therethrough adjacent opposing longitudinal ends thereof;

a mid-body disposed atop the central portion of the base between the first and second sidewalls of the base and having first and second troughs formed in a top surface thereof, wherein the troughs are separated by a partition wall and are aligned with the notches in the first and second sidewalls of the base, the mid-body further having first and second through holes formed therethrough adjacent opposing longitudinal ends thereof; and a cover disposed atop the mid-body and having a planar central portion and first and second sidewalls disposed on opposing sides of the central portion, the central portion further having first and second fastening bosses extending therefrom adjacent opposing longitudinal ends thereof, wherein the first and second fastening bosses extend through the first and second through holes of the mid-body and the first and second fastening holes of the base; and a conductive portion comprising:

opposing first and second terminal portions connected by parallel, spaced apart first and second fuse members, wherein the first and second fuse members are disposed within the first and second troughs of the mid-body and are separated by the partition wall, and wherein the first and second terminal portions cover the sides of the fuse body.

2. The fuse of claim 1, wherein the first and second terminal portions of the conductive portion extend around top and bottom surfaces of the fuse body.

3. The fuse of claim 2, wherein the first and second terminal portions have respective top and bottom flanges extending perpendicularly from top and bottom edges thereof.

4. The fuse of claim 3, wherein the first and second fuse members comprise respective first and second fusible elements, the first and second fusible elements being suspended above the bottom flanges of the first and second terminal portions and connected to the bottom flanges by respective legs extending from opposing ends of the first and second fusible elements.

5. The fuse of claim 4, wherein the legs of the first and second fuse members are disposed within the notches of the first and second sidewalls of the base.

6. The fuse of claim 1, wherein the cover incudes castellations extending from the first and second sidewalls, the castellations being disposed within the notches of the first and second sidewalls of the base.

7. The fuse of claim 1, wherein the first and second troughs of the mid-body are at least partially filled with an arc-quenching material.

8. The fuse of claim 1, wherein the first and second troughs of the mid-body include cavities formed in respective floors thereof.

9. The fuse of claim 8, wherein the cavities are at least partially filled with an arc-quenching material.

10. The fuse of claim 1, wherein the first and second fastening bosses of the cover are heat staked within the first and second fastening holes of the base.

11. The fuse of claim 1, wherein an entirety of the conductive portion is formed from a single, contiguous, unitary piece of material.

* * * * *